US007301609B2

(12) United States Patent
Cens et al.

(10) Patent No.: US 7,301,609 B2
(45) Date of Patent: Nov. 27, 2007

(54) MEASURING SONDE FOR A HYDROCARBON WELL

(75) Inventors: Fabien Cens, Massy (FR); Jean-Pierre Chyzak, Evry Gregy sur Yerre (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 129 days.

(21) Appl. No.: 10/526,954

(22) PCT Filed: Sep. 8, 2003

(86) PCT No.: PCT/EP03/10005

§ 371 (c)(1),
(2), (4) Date: Sep. 12, 2005

(87) PCT Pub. No.: WO2004/025078

PCT Pub. Date: Mar. 25, 2004

(65) Prior Publication Data

US 2006/0107736 A1 May 25, 2006

(30) Foreign Application Priority Data

Sep. 10, 2002 (FR) ..... 02 11203

(51) Int. Cl.
*G01P 3/36* (2006.01)

(52) U.S. Cl. ..... 356/28; 356/28.5; 33/544

(58) Field of Classification Search ..... 356/28
See application file for complete search history.

(56) References Cited

U.S. PATENT DOCUMENTS

| | | | | |
|---|---|---|---|---|
| 5,242,020 | A | | 9/1993 | Corben |
| 5,661,237 | A | | 8/1997 | Dussan V. et al. |
| 5,765,640 | A | | 6/1998 | Milne et al. |
| 6,137,621 | A | * | 10/2000 | Wu ..... 359/290 |

FOREIGN PATENT DOCUMENTS

| | | | |
|---|---|---|---|
| FR | 1549531 | A | 12/1968 |
| FR | 2267442 | A | 11/1975 |
| FR | 2797295 | A | 2/2001 |
| GB | 2294074 | * | 4/1996 |
| GB | 2294074 | A | 4/1996 |

* cited by examiner

*Primary Examiner*—Thomas H. Tarcza
*Assistant Examiner*—Luke D. Ratcliffe
(74) *Attorney, Agent, or Firm*—Bryan L. White; Kevin P. McEnaney; Dale V. Gaudier

(57) ABSTRACT

The invention provides a measuring sonde (1) for a hydrocarbon well, the sonde comprising a main body (2), a downstream arm (3), and an upstream arm (5), at least one of said arms being fitted with measurement means (6) for determining the characteristics of the fluid flowing in the well; said downstream and upstream arms being connected to the main body respectively via first and second sliding pivot links (A and E).

11 Claims, 2 Drawing Sheets

MEASURING SONDE FOR A HYDROCARBON WELL

Figure 1:
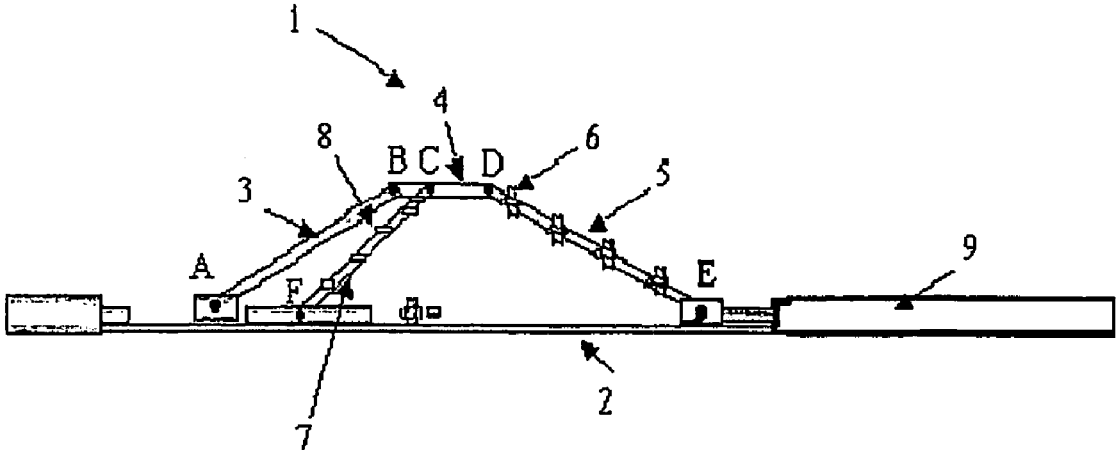

The present invention relates to a measuring sonde, in particular for hydrocarbon wells. A particularly advantageous application of the invention relates to a measuring sonde for a hydrocarbon well that is horizontal or highly deflected.

In order to perform surveillance and diagnosis functions in hydrocarbon wells that are in production, it is desirable to acquire a certain amount of data, mostly physical data. Essentially, said data relates to the multi-phase fluid that flows in the well (flow rate, proportions of the various phases, temperature, pressure, etc. . . . ). The data may also relate to certain characteristics of the well proper: ovalization, inclination, . . . .

Data of particular importance for the operator relates to the mean flow rate and the proportions of the various phases present in the multi-phase fluid. In order to acquire this data, it is necessary to deploy sensors down the well to analyze the nature of the fluids and also their speeds. Such sensors (optical or electrical) are generally carried by arms pivoted to move between a closed position inside a main body and an open position in which said arms extend across the stream. The assembly formed by the pivoted arms and the main body is called a "sonde". Measurements are then performed by lowering and raising the sonde in the well.

The measurements performed on the effluent can be performed in wells where the tool comes directly into contact with the rock formations or in wells where the walls have been covered in casing, cemented thereto. In all cases, it is possible to encounter constrictions in well diameter associated with the presence of production elements, or in non-cased wells, with collapse of the walls of the well. This gives rise to clear problems of sonde strength. The architecture of the sonde, and in particular the opening/closing mechanism for deploying the hinged arms and for retracting them inside the main body must enable the sondes to go past such constrictions without damage (crushing, bending), and this applies both when lowering the sonde down the well and when raising it. The same type of problem also arises when the coefficient of friction of the pivoted arms against the walls of the well becomes too great, particularly in non-cased wells where this can also prevent the sonde from moving along the well.

Various solutions have been proposed, in particular for vertical wells. Under such circumstances, it is easier to propose a mechanism that is strong and reliable since wells are generally cased (few problems due to coefficient of friction) and the phases of the effluent are naturally well mixed (constraints associated with the arm mechanism disturbing the stream are of less importance). By way of example, the sonde can be centered in the well and it can be fitted with spring blades which, by deforming, enable the sonde to go past constrictions without any risk of jamming, as illustrated in document U.S. Pat. No. 5,661,237. In addition, for a vertical well, the distribution of sensors and the number thereof is easier to design since the phases of the fluid are suitably mixed. Thus, for example, speed of the effluent can be measured using a single sensor whose measurements will be disturbed very little by the presence of the spring blades and the arms of the sonde which, when deployed across the well, obstruct a portion of the duct.

For wells that are horizontal or highly deviated, the flow characteristics of the effluent vary significantly and the fluids making it up become segregated (as a function of their densities) so as to travel at speeds that are different and can be very low (a few centimeters per second), or even in opposite directions. In addition, most such wells are not cased and the sonde comes into contact with the rock wall, with the major risk of constrictions due to collapsed portions of the well and to zones where coefficients of friction are high. Thereafter, given these characteristics, the flow will be disturbed more greatly by the presence of the sonde which makes it impossible to use spring blades. Finally, in this type of well, in order to support the tool's own weight, the spring blades would need to be overdimensioned thus making them quite useless.

Other solutions for closing the arms of the sonde have therefore been proposed, as illustrated in document GB 2 294 074. Nevertheless, those solutions describe the use of a pivot link between the arms and the body of the sonde for closing them in the event of a constriction or an obstacle. That solution is not satisfactory since, under such circumstances, there is nothing to prevent the blocked arm turning in the opposite direction to the closure direction. Since the tool will then continue to move down or up the well, that will cause the arm to become jammed and then bent, thereby damaging the sonde. It is necessary to stop taking measurements in order to repair the tool or to replace it, which is expensive.

An object of the invention is thus to propose a measuring sonde whose characteristics enable it to go past constrictions or any other element disturbing the shape of the duct in which measurements are being taken, and to do so both when going down the well and when going up the well, while minimizing the risk of damage to said sonde and the sensors it carries.

For this purpose, the invention provides a measuring sonde for a hydrocarbon well, the sonde comprising a main body, a downstream arm, and an upstream arm, at least one of said arms being fitted with measurement means for determining the characteristics of the fluid flowing in the well, the sonde being characterized in that said downstream and upstream arms are connected to the main body respectively via first and second sliding pivot links.

This operating characteristic of the sonde opening/closing mechanism allows the arm to fold appropriately each time the sonde goes past a constriction or whenever one of the arms becomes blocked if the coefficient of friction against the wall of the well becomes too great. The two sliding pivot links enable the arm that encounters an obstacle to take up a position that is suitable for causing the sonde to close instead of for causing the arm to become jammed or bent as can happen with prior art sondes where the arm closure mechanism operates by means of pivot links only.

In a preferred embodiment of the invention, the downstream arm and the upstream arm are connected respectively to first and second ends of a skid via first and second pivot links.

In this way, the downstream arm, the upstream arm, and the skid form a subassembly that can slide relative to the main body. The skid makes it possible to simplify and stiffen the architecture of said subassembly. Thus, the arms extend through the fluid to be characterized between the main body and the skid, with the main body and the skid being diametrically opposite each other in the well.

In an advantageous embodiment, the sonde has a secondary arm connected firstly to the main body via a third pivot link and secondly to the skid via a third sliding pivot link.

This secondary arm is particularly advantageous if the sonde is to be provided with optical sensors. Optical fibers are not extensible and they withstand stretching very poorly. Thus, because of the way it is linked to the main body and to the skid, the secondary arm cannot slide relative to the main body so the fiber is never subjected to traction.

In advantageous embodiments of the invention, the secondary arm is constituted by two parallel blades and/or the downstream arm and/or the upstream arm are constituted by two parallel blades interconnected by bridges. This feature has several functions. Firstly, the use of blades makes it possible to give the arm a shape which minimizes disturbance to the stream of fluid flowing in the duct. This is particularly important when using the sonde in a deviated or horizontal hydrocarbon well since the various phases of the effluent are segregated and may be traveling at different speeds, thus making it essential not to disturb such a flow if it is desired to take measurements that are reliable, in particular measurements of the speed of the fluid. The presence of bridges between the blades serve to stiffen the assembly. Advantageously, the measuring means are implanted on the arms, i.e. the blades, specifically at the locations of the bridges thus also making it possible to protect said measuring means, in particular against entering into collision with the rock formation of the well.

Advantageously, the downstream arm and/or the upstream arm is/are connected to a motor module enabling their movement relative to the main body to be controlled, said motor module being deactivatable. The use of the motor enables opening and closing of the arms of the sonde to be controlled from the surface. By means of this characteristic, it is possible to protect the sensors while lowering the sonde in the hydrocarbon well to the zone where measurements are to be performed. Thereafter, it is also possible to open and close the sonde while taking measurements so that all of the measuring means distributed on the arms sweep across the diameter of the duct, thereby increasing the precision of the results. Advantageously, the link between the motor module and the downstream and/or upstream arms can be disconnected. In this way, the sonde assembly is much easier to transport not only because the tool is thus made to be more compact, but also because the motor module is less fragile than the sonde itself so protective devices need only be provided for covering the sonde.

Other advantages and characteristics of the invention appear in the following description given with reference to the accompanying drawings, in which:

FIG. 1 is a diagrammatic view of a tool constituting an embodiment of the invention;

FIGS. 2*a* to 2*d* are diagrams showing the various positions occupied by the arms of the sonde of the invention; and FIGS. 3*a* to 3*d* are diagrams showing how the arms of the sonde move on encountering an obstacle while the sonde is being lowered down a well.

FIG. 1 shows a sonde 1 comprising a main body 2 and various pivoted arms. A particular application of this sonde relates to acquiring data for characterizing the flow of an effluent in a hydrocarbon well, in particular a well that is deviated or horizontal. The module constituted by the body of the sonde and the arms is connected, for example, to a set of other measuring modules (not shown) which are used to perform other types of measurement in the well such as temperature, pressure, etc. In a preferred embodiment of the invention, the body of the sonde and the pivoted arms carry measurements means, e.g. means for measuring the multiphase ratios and the flow speeds of an effluent flowing in the well. Advantageously, measurements are acquired both when going down the well and when going up the well. It is clear in FIG. 1 that such a sonde occupies an off-center position in the well, i.e. the main body 2 rests on a wall of the well, and when the arms of the sonde are in the open position they extend diametrically away from the body. In this way, the disposition of the elements of the sonde makes it possible to minimize the disturbance to the flow of fluid in the well, thereby limiting the risks of measurement errors.

In the embodiment shown in FIG. 1, a downstream, first arm 3 extends from the main body to a first end B of a skid 4. The downstream arm is connected to the main body via a pivot link at point B on the skid 4 and via a first sliding link coupled to a pivot link forming a sliding pivot at a point A. This sliding pivot enables the downstream arm 3 to move between an open position corresponding to extending across the duct carrying the flow of fluid to be characterized, and a closed position in which the downstream arm lies against the main body 2, as explained in greater detail below.

An upstream, second arm 5 situated further from the surface than the downstream arm 3 extends from the main body 2 to a second end D of the skid 4. The upstream arm is connected to the main body via a second sliding pivot link at a point E and via a pivot link to the point D on the skid 4. The upstream arm can thus move in the same manner as the downstream arm between an open position and a closed position. Advantageously, this arm has devices 6 for measuring the speeds of the various phases of the fluid, said devices being dispersed all along the upstream arm in order to pick up the speed of each of these phases when the phases are segregated. It is also possible to double the number of sensors at the end of the arm in order to improve measurement reliability in the high portion of the duct or well. As shown in FIG. 1, it is also possible to position a speed measuring device directly on the main body 2 of the sonde. In an embodiment, the speed measuring devices are miniature propellers, also known as mini-spinners.

The amplitude of the sliding that the upstream and downstream arms can perform both up and down relative to the main body is determined by abutments positioned on the main body and not shown for greater clarity. Each pivot link B and D also has an abutment (not shown) in order to limit pivoting of the arms relative to the skid. Advantageously, in order to avoid any risk of the arms bending, the arms can at most occupy a position in which they are in alignment with the skid 4 (as shown below with reference to FIG. 3*c*).

In the embodiment of FIG. 1, the sonde of the invention also has a secondary arm 7 extending between the main body and the skid 4 and positioned between the upstream and downstream arms. The secondary arm is connected via a pivot link to point F on the main body and via a sliding pivot link to point C on the skid. In this way, the secondary arm cannot slide relative to the sonde body, thus enabling optical sensors 8 to be positioned thereon, which sensors are particularly suitable for determining the ratio between the liquid and gas phases of effluent flowing along the well and typically comprising three phases: oil, water, and gas. The optical fibers connected to the optical sensors are inextensible so it is very important to prevent any axial displacement of the arm carrying such sensors so as to avoid damaging the fibers. It is also advantageous to double the number of sensors in the top portion of the secondary arm in order to improve measurement reliability in the high portion of the duct.

Advantageously, the downstream and upstream arms are constituted by parallel blades interconnected by bridges. The measurement means (e.g. speed sensors or electrical sensors) are then preferably installed beneath the bridges in order to protect them from the walls of the formation. The bridges also have another advantage of stiffening the arms and thus of increasing the lifetime of the sonde of the invention. Finally, the streamlined shape of the blades minimizes the disturbance to the stream of the fluid that is to be characterized. In general, the outside shape of the blades constituting the upstream and downstream arms and the dimensions thereof are such that in the fully-closed position the assembly comprising the upstream arm, the downstream arm, the skid, and the secondary arm, if any, is fully included within the general outline of the main body 2. Thus, in the closed position, the sonde of the invention is substantially cylindrical in shape, thus enabling it to be moved easily in a duct or in a well.

In the same manner as for the upstream and downstream arms, it is advantageous to make the secondary arm as two parallel blades. For reasons of compactness and the ability to close the sonde, these blades should be finer than the upstream and downstream arms so that the secondary arm can be received inside the upstream arm and be received fully therein in the closed position. Thus, if electrical or optical sensors are installed on the secondary arm, for example, it is preferable for them to be placed beneath the bridges of the downstream arm so as to protect them from the rock formation (for example).

As shown diagrammatically on FIG. 1, the sonde of the invention may also be provided with a motor module 9. Advantageously, the motor module is disconnectable. This characteristic makes it possible to separate said motor from the sonde so as to facilitate transport operations. In addition, the motor module may also be deactivatable so as to control opening and closing of the sonde from the surface, which can be particularly advantageous to avoid damaging the sonde while it is being lowered down the well towards the zone that is to be characterized. This module also makes it possible to open and close the upstream and downstream arms successively so as to cause them to scan across the entire diameter of the duct or the well while acquiring measurements, thereby improving the results obtained. Once the measuring zone has been reached, the module is deactivated when it is desired to lower or raise the sonde in the well or the duct while leaving the arms free to fold in on encountering an obstacle.

Figure 2A:
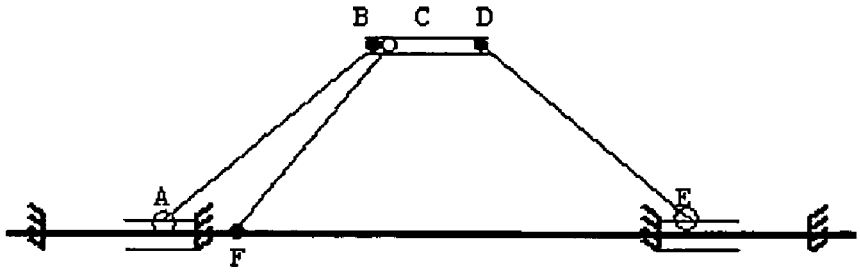

FIGS. 2*a* to 2*d* show various positions that the sonde can occupy. FIG. 2*a* shows the sonde in its maximally open position. The sliding pivots at points A and E respectively for the downstream and upstream arms are in abutment against the main body, but the pivot links B and D and the pivoting of the arms by means of the sliding pivots enable the sonde to fold in without danger of jamming on encountering a constriction.

Figure 2B:
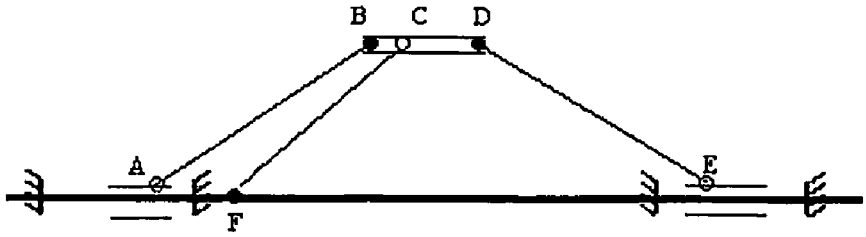
Figure 2C:
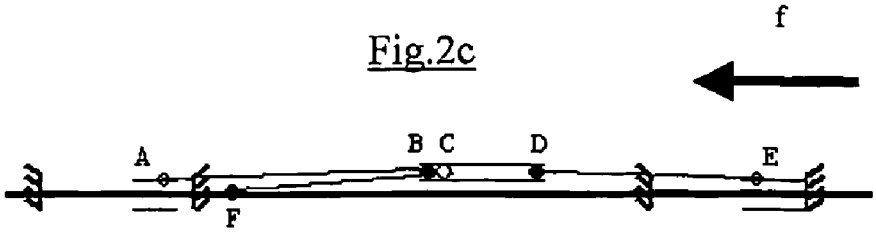
Figure 2D:
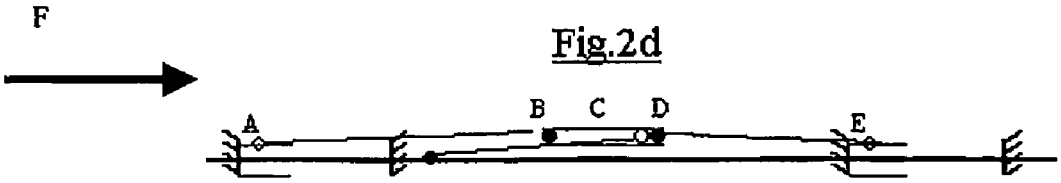

FIG. 2*b* shows the sonde in an intermediate open position in which the assembly comprising the downstream arm, the upstream arm, and the skid can slide at points A and E relative to the main body, the links B and E of the arms to the skid thus enabling the arms to fold in. FIGS. 2*c* and 2*d* show the sonde in two circumstances for a fully closed position. In this case, the assembly comprising the downstream arm, the upstream arm, the skid, and the secondary arm if any, is substantially flush with the outside diameter of the main body. In FIG. 2*c*, the upstream and downstream arms can slide relative to the main body by means of the sliding pivot at E, in the direction going towards the surface as represented by arrow f. The downstream arm is then pivoted about points B and A. In the example of FIG. 2*d*, the upstream and downstream arms can still slide relative to the main body because of the sliding pivot at A, this time in the downhole direction as represented by arrow F. The upstream arm is then pivoted about points D and E. In all of these examples of displacements, the secondary arm follows the movements of the downstream and upstream arms by virtue of the sliding pivot at C and the pivot at F.

FIGS. 3*a* to 3*d* are diagrams showing successive positions occupied by the sonde of the invention on going down past a constriction in a duct or a well that is not cased.

Figure 3A:
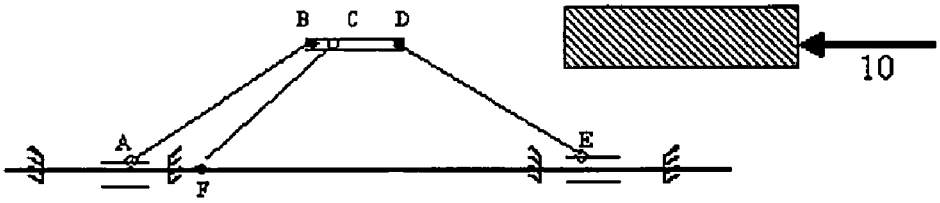
Figure 3B:
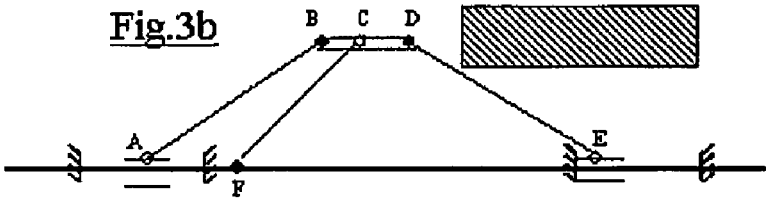
Figure 3C:
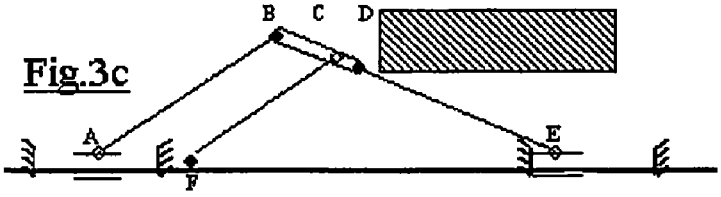
Figure 3D:
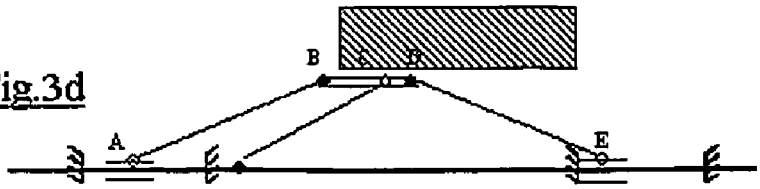

Prior to meeting the constriction 10, the downstream and upstream arms are free to move along the links A and E relative to the main body. When the upstream arm 5 reaches the constriction, the assembly comprising the upstream arm, the downstream arm 3, and the skid 4 slides until it comes into abutment in such a manner that for the upstream arm, only the pivot link at E is effective, as shown in FIG. 3*b*. At this moment, the upstream arm 5 begins to fold down until the skid 4 and said arm come into alignment, as shown in FIG. 3*c*. The links between the skid 4 and the downstream and upstream arms (points B and D) are fitted with abutments (not shown for greater clarity) which enable the skid to come into alignment with the arms on going past constrictions in order to make it easier to close the sonde. Thereafter, as shown in FIG. 3*d*, as the tool continues to advance (a surface mechanism, not shown, controls downward and upward movement of the sonde in the well), the sonde closes so as to go past the constriction 10 by virtue of the upstream arm sliding in the sliding pivot link A and pivoting at the pivot B. On going past a constriction while the sonde is being raised in the duct or the well, the displacements are identical but symmetrical relative to those described above with reference to FIGS. 3*a* to 3*d*.

In a zone having a high coefficient of friction (in particular in a non-cased well), the behavior of the sonde of the invention is identical except that it is the skid 4 that becomes blocked, e.g. against the rock formation, and it is the assembly comprising the upstream arm, the downstream arm, and the skid that slides until it reaches one of the two abutments on the sliding pivots A and E, after which the displacement of the arms is identical to or symmetrical with that described with reference to FIGS. 3*a* to 3*d*.

It is thus clear that the displacements of the arms of the sonde of the invention make it possible to avoid any risk of the arms jamming as they go past constrictions, with this being made possible in particular by the combination of two sliding pivots A and E relative to the main body. In addition, because of the sliding link with the skid and the pivot link with the main body, the displacement of the secondary arm is such that cables (and in particular optical cables) connecting the measurement means distributed thereon are never rolled or stretched.

The invention claim is:

1. A measuring sonde for a hydrocarbon well, the sonde comprising a main body, a downstream arm, an upstream arm, and a secondary arm, at least one of said three arms being fitted with measurement means for determining the characteristics of the fluid flowing in the well, wherein said downstream and upstream arms are connected to the main body respectively via first and second sliding pivot links (A and E); and to respectively first and second ends of a skid via first and second pivot links (B and D); and said secondary arm is connected firstly to the main body via a third pivot link (F) and secondly to the skid via a third sliding pivot link (C).

2. The measuring sonde according to claim 1, wherein the pivoting of the downstream and upstream arms relative to the skid is limited by the presence of abutments on the first and second pivot links.

3. The measuring sonde according to claim 1, wherein the secondary aim includes optical measurement means.

4. The measuring sonde according to claim 1, wherein the secondary arm is constituted by two parallel blades.

5. The measuring sonde according to claim 1, wherein the secondary arm can be received inside the downstream arm.

6. The measuring sonde according to claim 1, wherein the downstream arm and/or the upstream arm is/are constituted by parallel blades interconnected by bridges.

7. The measuring sonde according to claim 1, wherein die axis of the main body is off-center relative to the axis of the well.

8. The measuring sonde according to claim 1, wherein the downstream and upstream arms are pivoted relative to the main body in a closed position in which the arms are received inside said main body and an open position in which said arms extend across the stream flowing along the well.

9. The measuring sonde according to claim 1, wherein the downstream arm and/or the upstream arm is/are connected to a motor module enabling arm movement relative to the main body to be controlled, said motor module being deactivatable.

10. The measuring sonde according to claim 9, wherein the connection between the motor nodule and the downstream and/or upstream arms is separable.

11. The measuring sonde according to claim 1, wherein the upstream arm has measurement means for measuring the speed of the fluid flowing in the well.

* * * * *